United States Patent [19]

Bahder et al.

[11] 4,241,233

[45] Dec. 23, 1980

[54] METHOD OF FORMING DIELECTRIC MATERIAL FOR ELECTRICAL CABLE AND RESULTING STRUCTURE

[75] Inventors: George Bahder, Edison, N.J.; Mario Rabinowitz, Menlo Park, Calif.

[73] Assignee: Electric Power Research Institute, Inc., Palo Alto, Calif.

[21] Appl. No.: 928,269

[22] Filed: Jul. 26, 1978

[51] Int. Cl.[3] ..... H01B 3/16; H01B 9/04; H01B 12/00

[52] U.S. Cl. ..... 174/15 C; 174/15 S; 174/28

[58] Field of Search ..... 174/15 S, 15 C, 126 S, 174/128 S, 15 CA, 28, 29, 25 G

[56] References Cited

FOREIGN PATENT DOCUMENTS 2431212 1/1976 Fed. Rep. of Germany .
1212256 11/1970 United Kingdom .

*Primary Examiner*—Arthur T. Grimley
*Attorney, Agent, or Firm*—Flehr, Hohbach, Test

[57] ABSTRACT

A cable such as used in cryogenic and superconductive applications includes an inner conductor, an outer conductor or shield, and a solid dielectric between the inner and outer conductors. The dielectric is introduced into the space between conductors in liquid or gaseous form, preferably under pressure, and the temperature of the dielectric is lowered to or below the freezing point for the material. Pressure relief should the solid dielectric suddenly vaporize by rapid heat rise is provided by holes in the outer conductor or by scoring the inner surface of the outer conductor to provide rupture points in the conductor.

11 Claims, 2 Drawing Figures

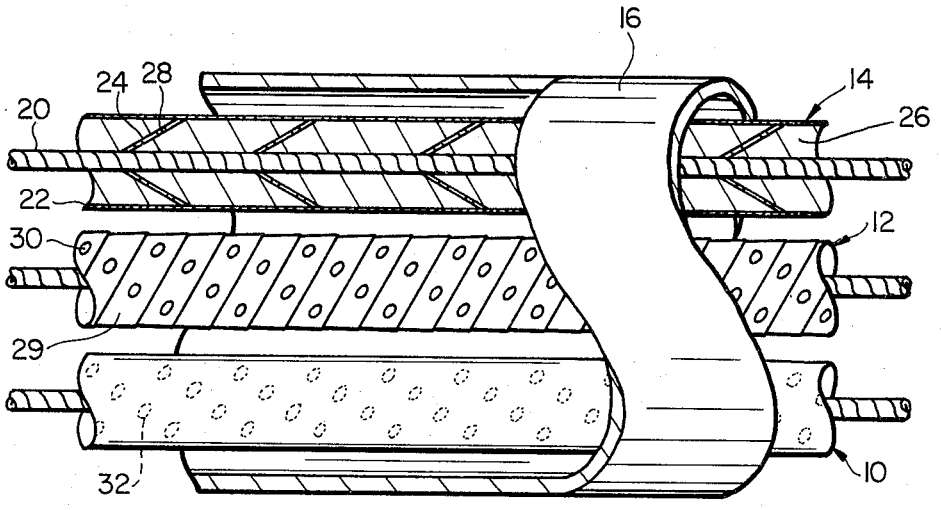
FIG__1
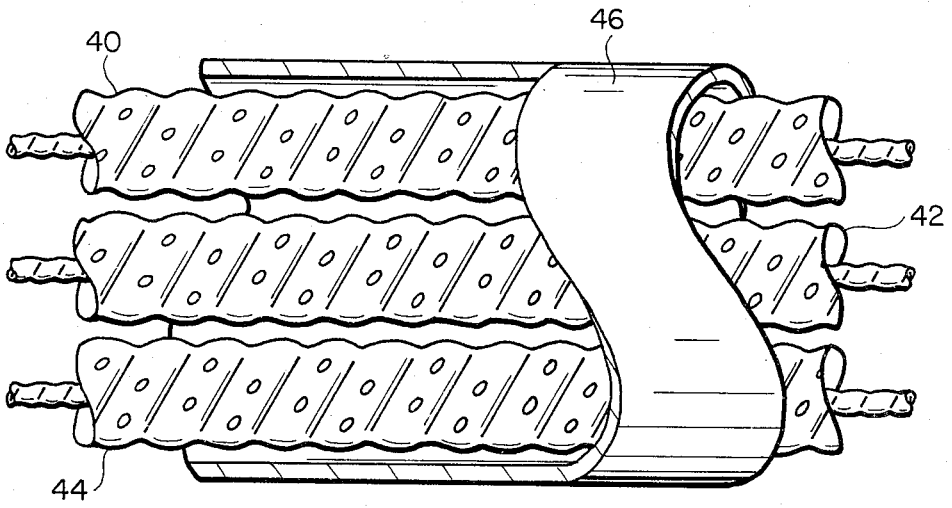
FIG__2

METHOD OF FORMING DIELECTRIC MATERIAL FOR ELECTRICAL CABLE AND RESULTING STRUCTURE

BACKGROUND OF THE INVENTION

This invention relates generally to electrical cables, and more particularly the invention relates to power cables and methods of manufacturing same.

Electrical cables are often formed in a sheathed or coaxial arrangement with one conductor positioned within another conductor. A dielectric material provides electrical isolation between the inner and outer conductors. In low temperature cables a coolant or cryogen is provided to lower the temperature and the resistance of the cable and hence reduce the power loss within the cable. Typically, the cable is positioned within a cryogenic envelope with a liquid coolant surrounding the cable. Also, the inner conductor may be hollow with the coolant flowing therethrough.

Electrical cables operating under either ambient or cryogenic conditions require an insulator having high dielectric strength, low dielectric loss, proper mechanical properties, and reasonable cost. Heretofore for low temperature cables a number of dielectrics have been employed with varying degrees of success. One approach has used the cryogen both as a coolant and as the dielectric. This approach has been largely unsuccessful because of the poor dielectric strength of most cryogens. Another approach has been to use a vacuum for both the electric and thermal insulation of the cable. While this removes the cryogen from the dielectric region, the use of a vacuum presents certain limitations including contamination of the entire line in case of a break at any point in the cable. In yet another approach, insulative tape has been wrapped on the conductors to provide a flexible cable insulation in the presence of a cryogen. However, the breakdown voltage of taped cables is a weak function of the dielectric strength of the tape and a stronger function of the dielectric strength of the cryogen which is present in the butt-gaps of the tape.

SUMMARY OF THE INVENTION

An object of the present invention is an electrical cable with improved dielectric properties.

Another object of the invention is a low temperature cable having an improved dielectric material.

Another object of the invention is a method of forming a solid dielectric material between conductors of a coaxial cable.

Still another object of the invention is a method of forming a solid dielectric material in a cryogenic cable.

Briefly, in accordance with the present invention a coaxial cable is provided with an improved solid dielectric material between conductors by filling the space between conductors with a dielectric material in either liquid or gaseous form, and then lowering the temperature of the dielectric material below the solidification point of the material to form the solid dielectric. In a cryogenic cable in which the inner conductor is hollow, the dielectric is advantageously formed beginning at the surface of the inner cable by passing a coolant through the inner conductor, whereby the dielectric forms with an absence of voids near the surface of the inner conductor where electrical field strength is greatest. Preferably, the dielectric material is provided in the space between the inner and outer conductors under pressure to minimize the presence of voids.

The outer conductor may be provided with a plurality of holes or the inner surface of the outer conductor may be scored to provide pressure relief points should the solid dielectric vaporize too rapidly with attendant pressure rise.

When the coaxial cable is provided within a cryogenic envelope, the entire space within the cryogenic envelope may be filled with the dielectric material, and the excess dielectric material is removed from the cryogenic envelope after the dielectric material within the coaxial cable solidifies.

Features of the invention include a cryogenic cable with a solid dielectric material between inner and outer conductors.

Another feature of the invention is a coaxial cable in which the outer conductor has a plurality of holes to release any pressure caused by rapid vaporization of the dielectric material.

Another feature of the invention is a coaxial cable in which the inner surface of the outer conductor is scored to provide pressure rupture points should the solid dielectric material vaporize too rapidly.

The invention and objects and features thereof will be more readily understood from the following detailed description and appended claims when taken with the drawing.

BRIEF DESCRIPTION OF THE DRAWING

FIG. 1 is a view partially in section of cryogenic cables in accordance with the present invention.

FIG. 2 is a view partially in section of another embodiment of a cable in accordance with the present invention.

DESCRIPTION OF THE PREFERRED EMBODIMENTS

FIG. 1 is a view partially in section of low temperature cables in accordance with the present invention. The coaxial cables 10, 12, and 14 are positioned within a cryogenic envelope 16 for three phase power transmission at low temperatures. The cables are shown in several forms for illustration purposes, and as used herein the term coaxial cable includes shielded and sheathed cables. A portion of envelope 16 is removed to illustrate the three cables therein. Cable 14 is shown in cross section and includes an inner conductor 20 supported within an outer conductor 22 by means of insulative spacers 24. A solidified dielectric material 26 is provided in the space between the inner conductor 20 and the outer conductor 22. Spacer 24 has a plurality of holes 28 therein to facilitate the flow of dielectric material in the space between the inner and outer conductors during the manufacturing of the cable, as will be described further hereinbelow. Inner conductor 20 is preferably hollow and accommodates the flow of a low temperature coolant or cryogen therethrough. The cryogenic material is also provided in the space within envelope 16 not occupied by the three cables.

In the embodiment of FIG. 1, cable 10 is rigid and the inner conductor and outer conductor may be made of a continuous conductive material. Alternatively, the inner and outer conductors may be formed of a conductive tape 29 wrapped on a mandrel as illustrated by flexible cables 12 and 14. Rigid cables will normally be assembled when the cryogenic envelope is installed, while flexible cables are pulled through after assembly of the envelope. In the case of superconductive cables, the superconductive material, niobium-tin ($Nb_3S_n$) or niobium-germanium ($Nb_3G_e$), for example, may be provided on the outer surface of the inner conductors in tape form. In accordance with one feature of the invention, the surface of the outer conductor may be provided with a plurality of holes 30 to relieve excess pressure should the solid dielectric material vaporize rapidly, as will be described further hereinbelow. Alternatively, the inner surface of the outer conductor may be scored to provide pressure rupture points to relieve the excess pressure in the event of rapid vaporization of the solid dielectric, as shown by dotted lines 32 on the surface of conductor 10. In case of failure, the ruptured material will go radially outward into a region of substantially no electric and no magnetic field, where its presence will have negligible consequence.

In another embodiment of low temperature cables in accordance with the present invention, as shown in FIG. 2, the cables 40, 42, and 44 as provided in cryogenic envelope 46 have inner and outer conductors made of corregated flexible cylinders whereby the cables are flexible and may be strung through the cryogenic envelope.

After the cables and cryogenic envelope are installed, the dielectric material is then formed within the cables. Preferably the dielectric material is placed in the space between the inner and outer conductors of the cable in liquid form under pressure to minimize the presence of voids in the space between conductors. Should voids form, their presence can be expected to be inconsequential for very low temperature operation. This is because most substances are solid below 12° K. and the vapor pressure in the voids would be extremely low. In contrast, voids in solids at ambient temperature tend to leave gas at atmospheric pressure and support partial electrical discharges within them leading to deleterious results. The material may be selected from a variety of substances which offer the necessary dielectric isolation and which are not toxic or corrosive. Following is an illustrative, but not all inclusive, list of fluid dielectrics which can be employed:

| FORMULA | NAME | LIQUIFICATION POINT°C. |
|---|---|---|
| Ar | Argon | −186 |
| $N_2$ | Nitrogen | −196 |
| $SF_6$ | Sulfur-hexafluoride | (sublimes at −64° C.) |
| $CO_2$ | Carbon dioxide | (sublimes at −79° C.) |
| $SClF_5$ | Sulfur chloride pentafluoride | −21 |
| $F_2NSF_5$ | Difluoramino sulfur pentafluoride | −18 |
| COS | Carbonyl sulfide | −50 |
| $N_2O$ | Nitrous oxide | −89 |
| $SOF_2$ | Thionyl fluoride | −44 |
| $CH_4$ | Methane | −162 |
| $CF_4$ | Carbon tetrafluoride | −128 |
| $CHClF_2$ | Chlorodifluoromethane | −41 |
| $CCl_2F_2$ | Dichlorodifluoromethane | −30 |
| $CClF_3$ | Chlorotrifluoromethane | −81 |
| $CBrF_3$ | Bromatrifluoromethane | −58 |
| $CF_3CF_3$ | Hexafluoroethane | −78 |
| $CClF_2CF_3$ | Chloropentafluorethane | −39 |
| $CF_3CF_3CF_3$ | Octafluoropropane | −37 |
| $CH_2{=}CH\,.\,CH_3$ | Propylene | −48 |
| $HC{\equiv}CH$ | Acetylene | −84 |
| $CH_3C{\equiv}CCF_3$ | Hexafluoro-2-butyne | −25 |
| $CF_3OCF_3$ | Bis (trifluoromethyl) ether | −59 |
| $(CF_2)_4$ | Octafluoro cyclobutane | −6 |
| $CF_3SCF_3$ | Bis (trifluoromethyl) sulfide | −22 |
| $CF_3SF_5$ | Trifluoromethyl sulfur penta fluoride | −20 |
| $SO_2$ | Sulfur dioxide | −10 |
| $CCl_4$ | Carbon tetrachloride | −76.8 |
| $CS_2$ | Carbon disulfide | 46.3 |
| $C_7F_{14}$ | Perfluoroheptene (also Perfluoromethylezchohexane) | |
| $C_4F_6$ | Hexafluorobutyne (also Hexafluorobutaliene) | |
| $C_8F_{16}$ | One, two-triofluoromethyl-decafluorocyclohexane | |
| $C_7F_8$ | Trifluoromethyl-penta fluorobenzene | |
| $isoC_4F_8$ | Perfluorobutene-2 | |
| $c\text{-}C_4F_8$ | Perfluorocyclobutane | |
| $C_6F_{10}$ | Perfluorocyclohexane | |
| $C_6F_{12}$ | Perfluorodimethylcyclobutane | |

After the pressurized liquid dielectric material is provided in the space between conductors of the coaxial cable, the temperature of the dielectric material is lowered below the solidification point of the material thereby forming a solid dielectric between the conductors. Preferably, the temperature is lowered by passing a liquid coolant or cryogen through the inner conductor of the coaxial cable, thereby causing the dielectric material to solidify beginning at the outer surface of the inner conductor to minimize the formation of voids near the surface of the inner conductor where the electric field strength is greatest during power transmission. The process of freezing from the inner radius outward also preferentially moves harmful impurities and imperfections outward away from the high electric field region.

When the outer surfaces of the cables are provided with holes such as cable 12 of FIG. 1, the entire cryogenic envelope is filled with the liquid dielectric material and a radial temperature gradient is maintained. After the dielectric material solidifies in the space between the inner and outer conductors of each cable, the remaining liquid dielectric material within the cryogenic envelope is removed and the envelope is purged prior to filling the envelope with cryogenic material. Thus, the solid dielectric remains within the cable but the remaining space within the envelope is filled with cryogenic material.

In accordance with another embodiment of the invention, the dielectric material may be passed in vapor form through the coaxial cable with the inner conductor cooled below the solidification temperature of the dielectric. As the gas flows through the cable, the dielectric material condenses in eptaxial growth on the inner conductor until the space between the two conductors is completely filled.

As above indicated, the solid spacers which maintain the inner conductor within the outer conductor of the coaxial cable, are provided with holes to allow the dielectric material in either liquid or gaseous form to flow the entire length of the cable.

The formation of cables having solid dielectric material in accordance with the invention provides improved dielectrics especially useful in low temperature cable applications. The resulting coaxial cable has improved dielectric strength and lower dielectric loss. Moreover, the cable is relatively inexpensive to fabricate.

While the invention has been described with reference to specific embodiments, the description is for illustrative purposes only and is not to be construed as limiting the scope of the invention. Various modifications, changes, and applications may occur to those skilled in the art without departing from the true spirit and scope of the invention as defined by the appended claims.

What is claimed is:

1. The method of forming a solid dielectric material between conductors of a coaxial cable, comprising the steps of:

filling the space between conductors with a dielectric material in fluid form, and lowering the temperature of said dielectric material below the solidification point of said material with a temperature gradient whereby said fluid solidifies outwardly.

2. The method defined by claim 1 wherein the inner conductor of said coaxial cable is hollow and the step of lowering the temperature includes passing a coolant through said inner conductor.

3. The method defined by claim 2 wherein the step of filling said space with dielectric material includes applying pressure to said dielectric material to minimize void formation.

4. The method defined by claim 2 wherein said coolant is a cryogen.

5. The method defined by claim 2 wherein said coaxial cable is provided within a cryogenic envelope and said outer conductor includes a plurality of holes through its surface, and said step of filling includes filling the space within said cryogenic envelope with said dielectric material and further including the step of removing excess liquid material from said cryogenic envelope after the dielectric material within said coaxial cable solidifies.

6. The method defined by claim 5 wherein the step of filling space in said coaxial cable and in said cryogenic envelope with dielectric material includes applying pressure to said dielectric material to minimize void formation.

7. The method defined by claim 1 wherein said fluid is a liquid.

8. The method defined by claim 5 wherein dielectric material is formed within a plurality of coaxial cables provided within said cryogenic envelope.

9. The method of forming a solid dielectric material between conductors of a coaxial cable comprising the steps of:

passing a dielectric material in gaseous form through said coaxial cable between said conductors, and cooling said gaseous dielectric material until a solid dielectric material is formed beginning at said inner conductor and extending outwardly to said outer conductor.

10. The method defined by claim 8 wherein the inner conductor of said coaxial cable is hollow and wherein the step of lowering the temperature includes passing a coolant through said inner conductor.

11. The method defined by claim 9 wherein said coolant is a cryogen.

* * * * *